United States Patent [19]

Griffin

[11] 4,378,925

[45] Apr. 5, 1983

[54] T-BRACKET SHELF ASSEMBLY

[75] Inventor: Charles E. Griffin, Florence, Ky.

[73] Assignee: Lingo Manufacturing Company, Florence, Ky.

[21] Appl. No.: 242,367

[22] Filed: Mar. 10, 1981

[51] Int. Cl.[3] ..... A47G 29/02

[52] U.S. Cl. ..... 248/242; 108/108; 211/187; 248/248

[58] Field of Search ..... 248/235, 242, 243, 247, 248/248, 250; 211/187, 190; 108/108

[56] References Cited

U.S. PATENT DOCUMENTS

| | | | |
|---|---|---|---|
| 918,039 | 4/1909 | Grundmann | 248/243 X |
| 2,218,894 | 10/1940 | Schlosser | 248/243 X |
| 2,787,382 | 4/1957 | Williams | 248/243 X |
| 3,248,079 | 4/1966 | Kennedy | 211/187 X |
| 3,316,863 | 5/1967 | Zock | 108/108 |
| 3,561,713 | 2/1971 | Berkowitz | 242/242 |

*Primary Examiner*—J. Franklin Foss

*Attorney, Agent, or Firm*—Frost & Jacobs

[57] ABSTRACT

An adjustable shelf assembly in which the shelf support is both vertically and angularly adjustable with respect to a vertical channel to which the shelf support connects. The shelf support has projections at its base which engage corresponding notches in the vertical channel to form the connection of the two parts. The uppermost projection is double T-shaped and the notches are also T-shaped. The use of a T-shape on both the shelf support and vertical channel provides a rigid and positive connection.

7 Claims, 9 Drawing Figures

T-BRACKET SHELF ASSEMBLY

BACKGROUND OF THE INVENTION

1. Field of the Invention

This invention relates to an adjustable shelf assembly and more particularly to an assembly in which a shelf support is vertically and angularly adjustable by means of T-shaped projections at the base of the support which engage corresponding T-shaped openings in a vertical channel.

2. Description of the Prior Art

Due to a wide variety of uses for shelving, many ways have been suggested to provide an adjustable shelf assembly. The desirability of a shelf support which is vertically adjustable alone is evidenced by numerous patents. In addition, the desirability of a support which is also angularly adjustable has been clearly indicated, exemplary assemblies are disclosed by U.S. Pat. No. 3,089,675 to Lozier, U.S. Pat. No. 3,093,094 to Oztekin and U.S. Pat. No. 3,182,945 to Sedo.

For the most part, assemblies of the prior art utilize lightweight sheet metal shelf supports that have flat and notched or stepped projections at the base of the support for varying the relative angle of the shelf. These projections typically engage corresponding rectangular slots or openings in a vertical channel which has a series of these slots to provide for vertical adjustment. Assemblies which depend on projections and slots of the type mentioned fail to provide suitable rigidity or stability against the jars and vibration typically occuring on a shelf. In addition, when the overlying shelf is subject to a heavy load, the thin, flat projections do not offer sufficient resistance to the shear forces produced.

Thus, it has been determined that a shelf support having a T-shaped projection is desirable in many applications. Assemblies incorporating this feature have been taught in U.S. Pat. No. 3,080,980 to Gibbons and U.S. Pat. No. 4,156,515 to Mochly. However, neither of these references couples a T-shaped projection with the capability for angular adjustment. Although U.S. Pat. No. 3,085,693 to Shell illustrates the use of a separate T-shaped extension to allow the shelf support to slope downwardly, a separate element interjects instability into the assembly even though the T-shape would provide greater strength. In these assemblies which use the T-shape projections, the vertical channels utilize conventional rectangular slots or openings which do not facilitate use of a T-shaped projection, since the support must be rotated or manipulated in some way before it can be located in the column.

SUMMARY OF THE INVENTION

The T-bracket shelf assembly of the present invention provides a shelf support that is adjustable both angularly and vertically. The base of the support has multiple projections which engage in corresponding notches of a series in a vertical channel which provides for vertical adjustment. The lower projections are elongated while the uppermost projection is double T-shaped. The notches of the vertical channel are also T-shaped.

When the support is positioned on the vertical channel using the space at the narrow portion of the first "T" of the projection, the support extends substantially perpendicularly to the vertical channel. However, when the support is positioned using the space at the narrow portion of the second "T"; the shelf support slopes downwardly at a predetermined angle. Consequently, the support is also adjustable between horizontal and downwardly sloping positions.

The support and channel are designed with primary emphasis on strength and stability. The T-shape of the uppermost projection on the support and the multiple lower projections distribute the forces of a shelf load to minimize stresses. in addition, the support is made of heavy gauge sheet metal and formed so that it incorporates a right angle configuration which provides greater support and stability for an overlying shelf.

In addition, the T-shape of the notches in the vertical channel provides for a positive locking action with the T-shaped projection, thus improving the stability of the T-bracket shelf assembly. The shape of the vertical support contributes to the strength of the assembly, since it also incorporates the basic channel structure.

DETAILED DESCRIPTION

Figure 1:
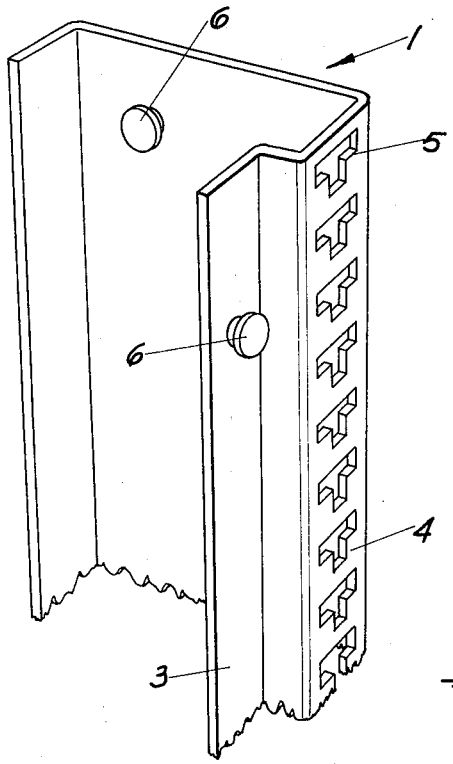
FIG. 1 is a fragmentary perspective view of the vertical channel of the T-bracket shelf assembly.
Figure 2:
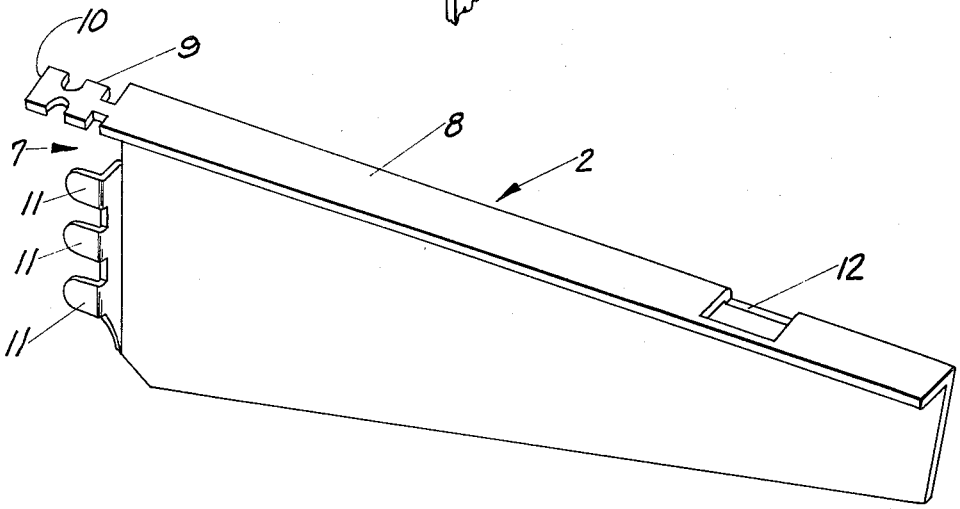
FIG. 2 is a perspective view of the shelf support of the T-bracket shelf assembly.

Shown in FIGS. 1 and 2 are the two components of the T-bracket shelf assembly, comprising a vertical channel 1 and a shelf support 2. Preferably each of these members is manufactured from heavy gauge sheet steel for maximum strength and durability. Alternatively, the channel 1 and support 2 could be extruded using a lightweight material, such as aluminum or plastic, to produce a more economical assembly especially suited for support of relatively light shelf loads.

Figure 7:
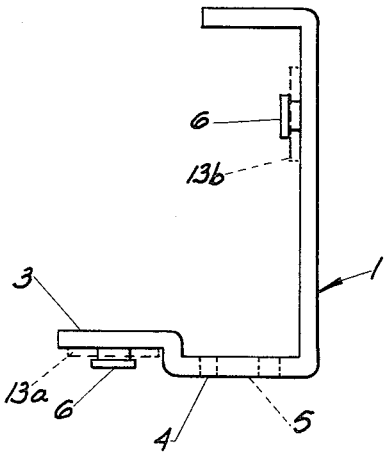
FIG. 7 is the top plan view of the vertical channel of the T-bracket shelf assembly.

As best seen in FIG. 7, the vertical channel 1 is basically C-shaped in its main body with an L-shaped extension 3 for additional rigidity and to facilitate the stacking and connecting of multiple channels. The vertical channel has a mounting face 4 upon which the shelf support 2 actually rests. As series of upright T-shaped notches 5 are cut or punched through the mounting surface 4. The notches 5 are of uniform shape and are equally spaced. Attached directly to the vertical channel are rivets 6 which have an enlarged head. The rivets 6 serve as keys in coupling the vertical channels, as will be more fully described hereinafter.

Figure 8:
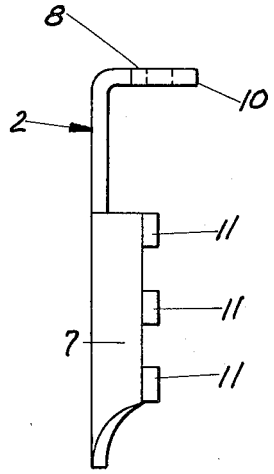
FIG. 8 is an elevational end view of the base end of the shelf support of the T-bracket shelf assembly.

The mating part to the vertical channel 1 is the shelf support 2. The shelf support is also manufactured from sheet metal, and incorporates a right angle structure in its design, as can be seen in FIGS. 2 and 8. At a base end 7 of the shelf support, there are several projections spaced in such a way as to engage the corresponding notches 5 in the vertical channel 1. The uppermost projection lies in the same plane as a shelf supporting surface 8 and comprises a first T-shaped projection 9 from which a second T-shaped projection 10 extends. By its design, the base end of the T-shaped projection 9 forms rectangular notches 9*a* with respect to the base end 7. The size of notch 9*a* enables the projection 9 to fit snugly within the narrow portion of the T-shaped notch 5 of the vertical channel 1, as described hereinafter. Similarly, rounded notches 10*a* are formed by projection 10. The rounded notch 10*a* is so shaped to facilitate proper location of the shelf support 2 at an angle, as will also be described later. Lower on the base end 7, and lying in a vertical plane, are three U-shaped projections 11. To provide for the proper engagement in the notches 5 of the vertical channel 1, the U-shaped projections 11 are formed so that they are in line vertically with the T-shaped projections 9 and 10, as seen in FIG. 8.

Another feature of the shelf support is a rectangular notch 12 which serves as a receptacle for a clip or other fastening means for attaching a shelf to the support 2. As seen in FIG. 2 the lower edge of the shelf support is upwardly inclined from the base end 7 to minimize material usage while retaining strength. Also, the lower portion of the base end 7 slopes downwardly from the lowermost projection 11 to allow for clearance necessary in positioning the shelf support 2 on the vertical channel 1.

Figure 3:
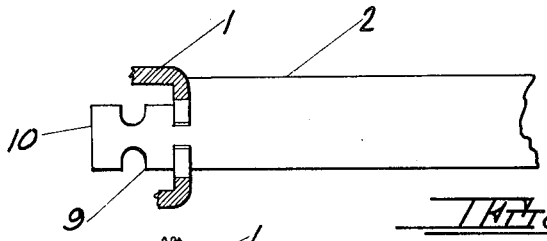
FIG. 3 is a fragmentary top plan view of the shelf support inserted in the vertical channel in a horizontal position.
Figure 4:
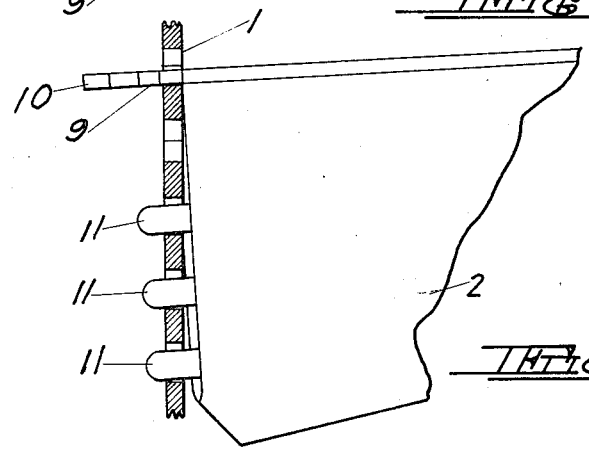
FIG. 4 is a fragmentary side elevational view of the shelf support inserted in the vertical channel in a horizontal position.

Connection of the shelf support 2 to the vertical channel 1 in a horizontal position is illustrated in FIGS. 3 and 4. This connection is accomplished by tilting the shelf support slightly upward, so that the T-shaped projections 9 and 10 can pass through the upper portion of the T-shaped notch 5 at the desired height on the vertical channel. When the projections 9 and 10 are fully within the notch 5, the shelf support is moved down so that the rectangular notches 9*a* at the base of the T-shaped projection 9 engage the lower portion of the notch 5 until projection 9 makes contact with the bottom of the notch. The shelf support is then brought to a horizontal position, as seen in FIG. 4, with the lower projections 11 passing into and resting on the base of corresponding notches in the vertical channel. The shelf support is securely held in this position by the restraint provided by projection 9, as seen in FIG. 3, and the support contributed by the lower projections 11, as indicated in FIG. 4. Removal of the shelf support for repositioning can be accomplished by merely reversing the previously stated procedure.

Figure 5:
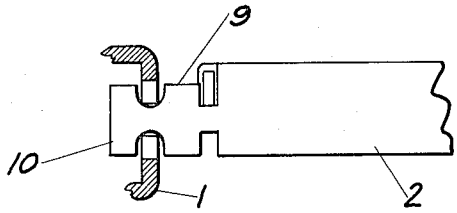
FIG. 5 is a fragmentary top plan view of the shelf support inserted in the vertical channel in a downwardly sloping position.
Figure 6:
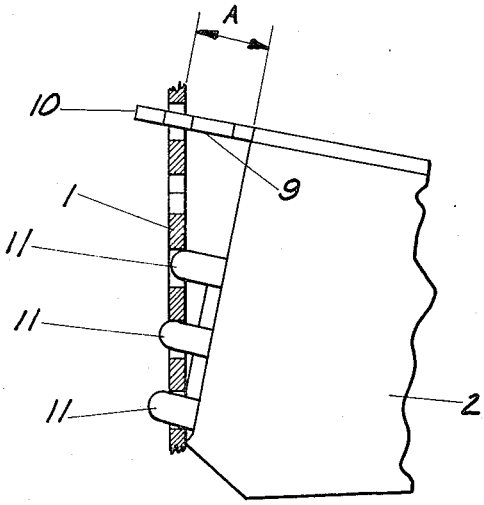
FIG. 6 is a fragmentary side elevational view of the shelf support inserted in the vertical channel in a downwardly sloping position.

Alternatively, the shelf support may be connected to the vertical channel in a downwardly sloping configuration, as shown in FIGS. 5 and 6. For this type of connection only the second T-shaped projection 10 is slid through the upper portion of the notch 5. The rounded notches 10*a* at the base or narrow position of the T-shaped projection 10 are then slid down into the lower portion of the T-shaped notch 5, to a position illustrated in FIG. 5. The shelf support is then permitted to rotate downwardly, pivoting at the connection just made, with the lower projections 11 passing into corresponding notches 5 and resting in the position shown in FIG. 6. In this position, the shelf support is secured by restraint from the second T-shaped projection 10 and supported by the two lowermost projections 11. The angle at which the shelf support is positioned is directly determined by the structure of the T-shaped projection of the shelf support; i.e., by the distance from the base end 7 of the shelf support to the second T-shaped projection 10, as indicated by dimension A in FIG. 6.

Figure 9:
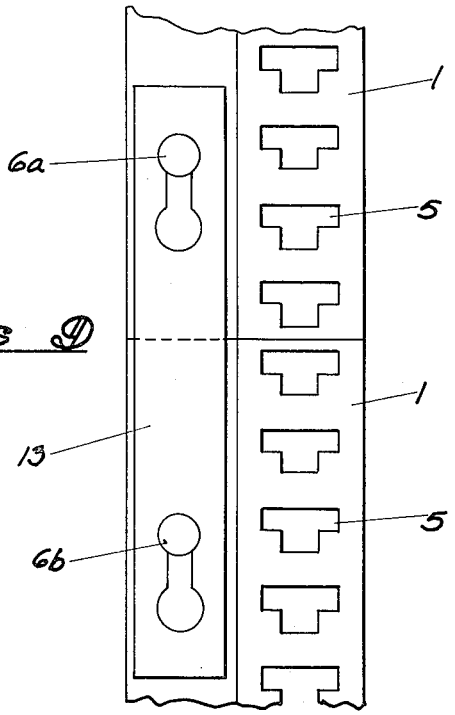
FIG. 9 is a fragmentary front elevational view illustrating connecting means for two vertical channels of the T-bracket shelf assembly.

As noted previously, the vertical channels have rivets 6 which facilitate the coupling of channels stacked vertically, as illustrated in FIG. 9. The vertical channels are connected by rigid rectangular straps 13. Two straps would be used to couple each pair of vertical channels as indicated by dotted lines in FIG. 7, 13*a* serving as a front strap and 13*b* serving as a side strap. Each strap 13 is notched so that it will pass over the heads of the rivet 6*a* on the upper channel and rivet 6*b* on the lower channel as seen in FIG. 9. The strap slides down over the inner diameter of the rivet, in such a position it cannot pass over the heads of the rivets. The straps 13 are rigid, and when properly in place provide a correspondingly rigid lock connecting the two vertical channels. In order to effectively stack the channels as described, the sections of channel are cut in such a way as to maintain the proper spacing between the notches 5 and not impair the locating of the shelf support at whatever position desired.

As should now be evident, the invention provides a T-bracket shelf assembly which incorporates multiple T-shaped projections on a shelf support which engage T-shaped notches in a vertical channel. Variations and modifications can be made without departing from the spirit and purpose of the invention.

I claim:

1. A shelf supporting assembly comprising:

a vertical channel having a plurality of T-shaped vertically spaced openings therein, said T-shaped openings each being defined by a horizontally disposed upper slot and a vertically disposed lower slot projecting downwardly from and in communication with said upper slot centrally thereof;

an elongated shelf supporting bracket comprising a body having a horizontally disposed upper edge and a vertically disposed base at one end thereof adapted to be seated against said vertical channel;

a plurality of projections extending rearwardly from said body for selective engagement with the T-shaped openings in said channel;

a first of said projections comprising a horizontally disposed pair of T-shaped elements lying in tandem relation to each other and extending in prolongation of the upper edge of said body, said T-shaped elements each having a top and a centrally disposed leg, the tops of said T-shaped elements each being of a width to be selectely passed through the upper slots of said T-shaped openings when the body of said shelf supporting bracket is vertically disposed, the legs of said T-shaped elements being of a width to be received in the lower slots of said T-shaped openings, the tops of said T-shaped elements being wider than said lower slots, whereby said T-shaped elements may be selectively passed through one of said T-shaped openings and the shelf supporting bracket moved downwardly so as to engage the corresponding leg of the T-shaped element in the lower slot of said opening with the outer ends of the top of the T-shaped element engaging the channel on opposite sides of said lower slot, the shelf supporting bracket extending horizontally outwardly from said channel when the innermost of said T-shaped elements is engaged in said T-shaped opening, and said shelf supporting bracket is inclined downwardly relative to said channel when the other of said T-shaped elements is engaged in said T-shaped opening; and at least one lower projection extending rearwardly from the base of said shelf supporting bracket, said lower projection being connected to said vertical base by a connecting member disposed at right angles to said vertical base and engaging in one of the T-shape openings underlying the T-shaped opening in which said first projection is engaged.

2. The assembly recited in claim 1 including a plurality of said vertical channels stacked one upon the other, and means for coupling sections of said vertical channels so stacked together.

3. The assembly recited in claim 2 wherein said means for coupling comprises rivets attached to said vertical channels and a rigid, notched rectangular strap, whereby notches in said strap engage said rivets to lock said vertical channels together.

4. The assembly recited in claim 1 wherein said shelf support has an upper surface with a notch therein, such that said notch receives a shelf anchoring clip.

5. The shelf supporting assembly claimed in claim 1 wherein said shelf supporting bracket has a plurality of lower projection each engagable with successive T-shaped openings in said channel.

6. The shelf supporting assembly claimed in claim 5 wherein each of said lower projections is vertically disposed and of U-shaped configuration, said lower projections being positioned to engage the lower slots of adjacent ones of said T-shaped openings.

7. The shelf supporting assembly claimed in claim 6 wherein the top and leg of said innermost T-shaped element are defined by rectangular notches in said first projections, and wherein the top and leg of the other of said T-shaped elements are defined by rounded notches in said first projection.

* * * * *